United States Patent [19]

Barnes

[11] Patent Number: 4,701,749

[45] Date of Patent: Oct. 20, 1987

[54] ELECTROACOUSTIC CALLING DEVICE WITH UNIVERSAL BEARING SUPPORTING A SOUND APERTURE CLOSURE MEMBER

[75] Inventor: Harold E. Barnes, Didmarton Nr Badminton, United Kingdom

[73] Assignee: U.S. Philips Corporation, New York, N.Y.

[21] Appl. No.: 806,731

[22] Filed: Dec. 9, 1985

[30] Foreign Application Priority Data

Dec. 19, 1984 [GB] United Kingdom ..... 8432013

[51] Int. Cl.[4] ..... G10K 1/36; G10K 9/12

[52] U.S. Cl. ..... 340/384 R; 116/149; 340/384 E; 381/158

[58] Field of Search ..... 340/384 E, 384 R, 388, 340/396, 397, 401–404; 179/180, 187, 188; 310/322, 324; 116/149, 148, 152; 181/143, 148, 184–186, 198, 242; 381/104, 106, 109, 157, 158; 384/246, 191.1, 192, 495, 558; 403/122, 145, 152, 164, 57, 73, 91; 379/375

[56] References Cited

U.S. PATENT DOCUMENTS

| | | | |
|---|---|---|---|
| 933,228 | 9/1909 | Burkholder | 179/188 |
| 2,425,061 | 8/1947 | Hart | 179/188 |
| 2,537,200 | 1/1951 | Zar | 384/246 |
| 2,613,119 | 10/1952 | Seemann | 384/246 |
| 2,826,649 | 3/1958 | Desbrow | 179/187 |
| 4,027,116 | 5/1977 | Nakamura | 179/180 |
| 4,054,870 | 10/1977 | Barber | 340/397 |
| 4,122,365 | 10/1978 | Stephens | 310/324 |
| 4,319,098 | 3/1982 | Baitcher | 179/180 |
| 4,505,165 | 3/1985 | Wiczer | 384/246 |
| 4,574,272 | 3/1986 | Brown | 340/384 E |

FOREIGN PATENT DOCUMENTS

| | | |
|---|---|---|
| 2082018A | 2/1982 | United Kingdom . |
| 2115648A | 9/1983 | United Kingdom . |

*Primary Examiner*—James L. Rowland
*Assistant Examiner*—Brent A. Swarthout
*Attorney, Agent, or Firm*—Thomas A. Briody; Jack Oisher; William J. Streeter

[57] ABSTRACT

An electroacoustic calling device comprising a piezoelectric transducer contained in a housing with an aperture therein through which sound is emitted. A closure member for controlling the size of the aperture, and hence the volume of emitted sound, is located in a recess in an arm pivotally mounted on the housing and is urged against the exterior surface of the housing by a projection at the bottom of the recess. The resulting essentially point contact between the closure member and the recess allows the surface of the closure member to align accurately with the surface of the housing, thereby minimizing leakage of sound between such surfaces.

6 Claims, 5 Drawing Figures

Fig. 1.
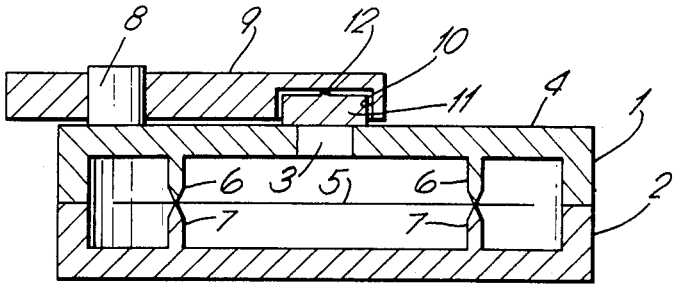
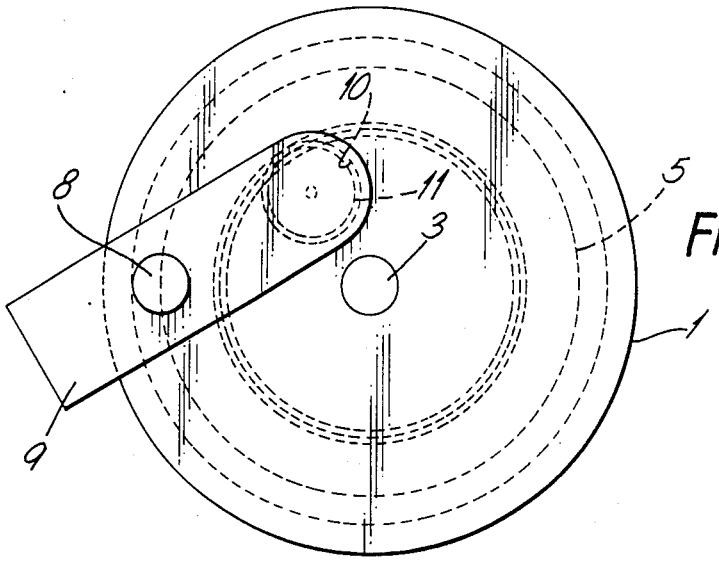
Fig. 2.
Fig. 3a.
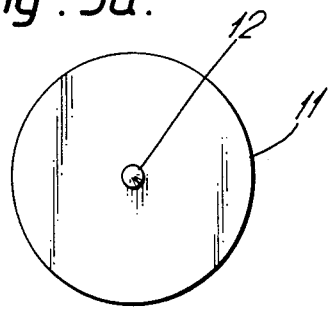
Fig. 3b.
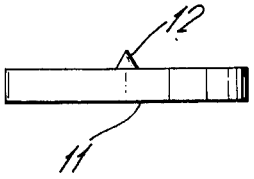

ELECTROACOUSTIC CALLING DEVICE WITH UNIVERSAL BEARING SUPPORTING A SOUND APERTURE CLOSURE MEMBER

BACKGROUND OF THE INVENTION

1. Field of the Invention

The invention relates to an electroacoustic calling device comprising an electroacoustic transducer mounted in a housing, said housing having an aperture or a group of apertures in a wall thereof through which aperture(s) sound waves may be emitted from the housing, said device further comprising a closure member having a surface which is movable across the wall of the housing to cover to a greater or lesser extent said aperture(s), the profile of the surface of the closure member and the exterior surface of the wall in the region of the aperture being complementary.

2. Description of the related art

Such devices are used in telephone instruments and may be of the form shown in U.K. Patent Application No. 2082018A or 2115648A. The prior art devices have a closure member which is mounted for pivotal movement with respect to a point on the housing in order to provide a variable closure of one or more apertures which has the effect of controlling the intensity of the sound waves escaping from the aperture(s). However, this arrangement has the disadvantage that any misalignment between the outer surface of the wall of the housing and the contacting surface of the closure member will allow sound to leak out between these surfaces. This means that the minimum sound level will vary from instrument to instrument since the engagement between these surfaces will differ with normal materials and tolerances.

SUMMARY OF THE INVENTION

It is an object of the invention to enable the provision of an electroacoustic calling device of the type set forth in the opening paragraph in which a more effective seal between the wall containing the aperture(s) and the closure member may be obtained.

The invention provides an electroacoustic calling device as set forth in the opening paragraph characterised in that the surface of the closure member is urged against the exterior surface of the wall of the housing by means of a universal bearing which, when the closure member is moved to cover the aperture(s), aligns the surface of the closure member with the exterior surface of the wall and thereby minimizes leakage of sound waves therebetween.

By urging the closure member against the housing using a universal bearing, alignment of the surface of the closure member with that of the housing is improved thus reducing sound leakage to a low level. This can be advantageous even if the sound output is not required to be reducable to zero since a controllable size of aperture can be achieved to give the minimum required sound output level which is not affected by additional sound leakage which may vary from device to device.

The closure member may comprise a plate located in a recess in an arm which is pivotted about a point on the housing so that rotation of the arm about the pivot causes the plate to move across the aperture.

This enables a relatively simple and inexpensive device to be produced, the arm and plate being suitable for manufacture as injection moulded plastics parts.

The plate may be provided with a projection which forms a point contact with the bottom of the recess. This results in a particularly simple and inexpensive universal bearing, especially if the plate is formed by injection molding, since the projection and the plate can both be formed in the same molding operation. However, the projection could alternatively be formed on the bottom of the recess and still result in effectively the same construction and result.

In one embodiment of the device the surface of the closure member is planar.

By providing the housing and closure member with planar mating surfaces it is relatively easy to ensure good sealing between the surfaces. It would be more difficult to match spherical surfaces, for example, so as to ensure low sound wave leakage.

The electroacoustic transducer may comprise a piezoelectric disc. A loudspeaker cone may be attached to the disc.

This enables an increased sound volume to be produced by the device and enables the position of the disc in a direction parallel to its plane to be fixed.

BRIEF DESCRIPTION OF THE DRAWINGS

Embodiments of the invention will now be described, by way of example, with reference to the accompanying drawings, in which:

FIG. 1 is a cross sectional view of a first embodiment of an electroacoutic calling device according to the invention, FIG. 2 is a plan view of the electroacoustic calling device of FIG. 1, FIG. 3*a* and *b* show in plan and elevation views respectively a closure member suitable for use in the device of FIG. 1.

DESCRIPTION OF THE PREFERRED EMBODIMENTS

Figure 4:
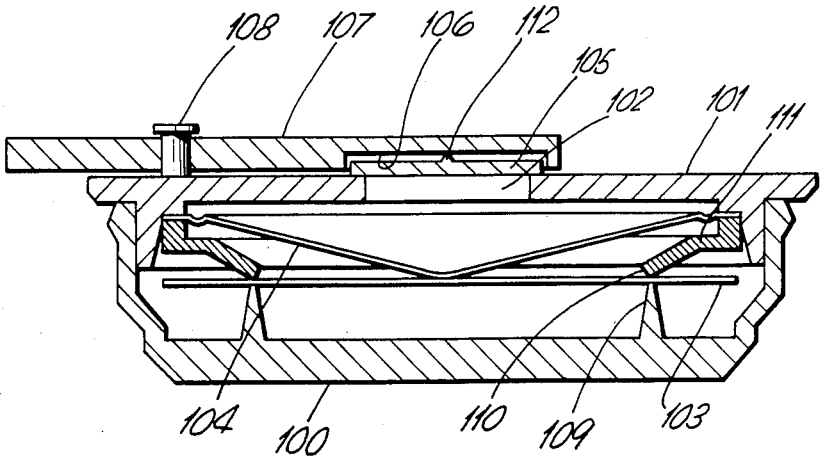
FIG. 4 is a cross sectional view of a second embodiment of an electroacoustic calling device according to the invention.

FIG. 1 shows a cross-sectional view of an electroacoustic calling device which is suitable for use in a telephone instrument as a tone sounder. Such tone sounders are increasingly being used instead of bells as they are more compatible with the electronic circuits which are increasingly fitted in present day telephone instruments. The device shown in FIG. 1 comprises upper 1 and lower 2 casings which are connected together to form a housing having an aperture 3 in a planar wall 4. As can be seen from FIG. 2 which is a plan view of the calling device shown in FIG. 1 the housing is circular in plan. A circular disc 5 of piezoelectric material is mounted between two circular projections 6,7 which extend from the upper 1 and lower 2 casings respectively. The upper casing 1 has a cylindrical projection 8 which acts as a pivotal mounting for an arm 9 which has a recess 10 facing the planar surface 4 of the upper casing 1. A plate 11 is located within the recess 10 and is urged against the planar surface 4 by the arm 9. The plate 11 is provided with a projection 12 which forms an essentially point contact with the recess 10. Thus the projection 12 and recess 10 form a universal bearing between the arm 9 and the plate 11 so that the lower surface of the plate 11 will lie in substantially the same plane as the planar surface 4, the plate 11 being free to rotate about any axis in the plane of the recess. The projection 12 is a convenient and inexpensive embodiment of a universal bearing since it can be easily produced if the plate 11 and/or arm 9 are formed by injection molding. However other forms of coupling between the arm 9 and plate 11 which allow universal movement of the plate relative to the arm could be used, for example a ball and socket joint. Clearly if any form of universal joint is used to couple the arm and plate a recess in the arm is not necessary. The recess in the embodiment illustrated in FIG. 1 is present to locate the plate 11 between the arm 9 and upper housing 1.

The embodiment shown in FIGS. 1 and 2 has the advantage that the plate 11 is able to align itself with the upper surface 4 of the upper casing and consequently to provide an effective closure of the aperture 3 so that when the aperture 3 is covered the level of sound emitted is reduced to a minimum.

As shown in FIG. 3 the plate 11 may be in the form of a disc and be provided with a conical projection 12 through which contact is made with the bottom of the recess 10 in the arm 9. It is, of course, alternatively possible to provide the projection on the bottom of the recess 10. In either instance the projection acting on a relatively flat surface will provide a universal bearing, i.e. it will allow the disc 11 to align with the surface 4 of the upper casing 1 regardless of any play in the pivotal joint between the arm 9 and projection 8.

It is not essential that the arm 9 is pivotted about a point on the housing if the housing and arm 9 are separately fixed to a further member which may, for example, be the casing of a telephone instrument. Also, the arm 9 could be replaced by a disc shaped member of the kind shown in U.K. Patent Application No. 2115648A modified to provide a recess in which to locate the plate 11. Further, the plate 11 could be modified to contain the arrangement of holes disclosed in that application if it is retained by means of a spider rather than a recess.

FIG. 4 shows a cross-sectional view of a second embodiment of an electroacoustic calling device according to the invention, the calling device comprising a lower casing 100, an upper casing 101 provided with an aperture 102, piezoelectric disc element 103, a loudspeaker cone 104, and a closure member in the form of a disc 105 located in a recess 106 in an arm 107 which is mounted for rotation about a boss 108 on the upper casing 101. The piezoelectric disc 103 is mounted between two annular knife edges 109 and 110. The first, 109, is integrally formed with the lower casing 100 while the second, 110, is integrally formed as part of an annular member 111 which is clamped between upper casing 101 and knife edge 109 of lowing casing 100. The loudspeaker cone has its apex connected to the centre of the piezoelectric disc, for example by means of an adhesive, and has an annular flange which is clamped between the annular member 111 and the upper casing 101.

The closure member 105 is urged against the upper surface of the upper casing 101 by the arm 107 via a universal bearing which comprises a projection 112 in the recess 106. Clearly the modifications of the arm and closure plate described with reference to FIGS. 1 to 3 are equally applicable to the embodiment of FIG. 4.

The addition of the loudspeaker cone 104 serves to increase the sound volume available from a given electrical input and also serves to locate the disc 103 and prevent movement of the disc in the horizontal direction (as shown in FIG. 4) when the unit is subject to shock. This is desirable to minimise the possibility of the edge of the disc 103 coming into contact with the housing when the device is subject to mechanical shock. The piezoelectric disc 103 is mounted so that the knife edge annular projections 109, 110 are at nodal points on the disc, the maximum amplitude of vibrations being at the centre of the disc where the apex of the cone 104 is attached.

Clearly the arm 9 or 107 could be fixed with the housing pivotted about a point so that relative movement between the aperture and closure member is produced.

The universal bearing may take any convenient form, for example the projection could be hemispherical or the closure member could be connected to the arm by a universal joint which may be of various well known forms. The closure member need not be of a plate like form, particularly if a different form of universal bearing is employed, for example there is no limit to its thickness, the only constraint is that the contacting surfaces should not be convex to enable effective and reproducible sealing of the aperture. The aperture 3 or 102 in the housing need not be a single aperture but may be formed by a plurality of apertures grouped together.

I claim:

1. In an electroacoustic calling device comprising an electroacoustic transducer mounted in a housing, said housing having at least one aperture in a wall thereof through which sound waves may be emitted from the housing, said device further comprising a closure member located in a recess in an arm which is pivotally mounted on the housing, whereby rotation of said arm about its pivot causes a surface of the closure member to move across an exterior surface of the wall of said housing to at least partially cover said aperture, said surface of the closure member and said exterior surface of the housing wall in the region of the aperture being complementary, the improvement characterized in that: said surface of the closure member is urged against said exterior surface of the housing wall by means of a universal bearing which, when the closure member is moved to cover the aperture, causes the surface of the closure member to align with said exterior surface of the housing wall and thereby minimize leakage of sound waves between such surfaces; said universal bearing being located between the closure member and the bottom of the recess in said arm and providing universally rotatable contact there-between.

2. A device as claimed in claim 1, characterized in that said universal bearing comprises a projection on the closure member, such projection constituting an essentially point contact between the closure member and the bottom of the recess.

3. A device as claimed in claim 1, characterized in that said universal bearing comprises a projection at the bottom of the recess, such projection constituting an essentially point contact between the closure member and the bottom of the recess.

4. A device as claimed in claim 1 in which the electroacoustic transducer comprises a piezoelectric disc.

5. A device as claimed in any of claims 1, 2 or 3, characterized in that the closure member is a plate having planar surfaces.

6. A device as claimed in claim 4, in which a loudspeaker cone is attached to the piezoelectric disc.

* * * * *